United States Patent [19]

Boyden

[11] Patent Number: 4,696,591

[45] Date of Patent: Sep. 29, 1987

[54] FAN FOLDED PRINTER OUTPUT COLLECTOR

[76] Inventor: Robert W. Boyden, 6 Lakeview Ct., Novato, Calif. 94947

[21] Appl. No.: 831,224

[22] Filed: Feb. 19, 1986

[51] Int. Cl.[4] ..... B41J 15/04

[52] U.S. Cl. ..... 400/613.2; 400/625; 400/646; 226/196; 403/410

[58] Field of Search ..... 493/410, 446, 455, 460, 493/461; 226/196, 199, 86; 400/625, 613, 613.2, 613.4, 616, 646, 647, 647.1, 645, 645.1–645.5

[56] References Cited

U.S. PATENT DOCUMENTS

| | | | |
|---|---|---|---|
| 2,548,715 | 4/1951 | Fitzgerald | 400/646 |
| 2,973,081 | 2/1961 | Maidment et al. | 400/617.2 |
| 3,129,802 | 4/1964 | Engle | 400/645 |
| 3,190,639 | 6/1965 | Johnson et al. | 493/410 |
| 3,276,766 | 10/1966 | Lambert | 270/39 |
| 3,415,507 | 12/1968 | Eckert et al. | 493/410 |
| 3,447,657 | 6/1969 | Majors | 400/614 |
| 4,094,498 | 6/1978 | Schuller | 270/52.5 |
| 4,095,779 | 6/1978 | Imagi et al. | 270/30 |
| 4,107,700 | 8/1978 | Sornod | 400/613.2 |
| 4,226,410 | 10/1980 | MacIntosh Sr. | 400/613.2 |
| 4,456,240 | 6/1984 | Chn et al. | 400/625 |
| 4,515,490 | 5/1985 | Marker, | 400/613.2 |
| 4,541,749 | 9/1985 | McCoy | 400/613.2 |
| 4,660,471 | 4/1987 | Wright, Jr. et al. | 400/613.2 |

FOREIGN PATENT DOCUMENTS

| | | | |
|---|---|---|---|
| 0150902 | 8/1985 | European Pat. Off. | 270/41 |
| 2251324 | 5/1974 | Fed. Rep. of Germany | 493/410 |
| 3027190 | 2/1982 | Fed. Rep. of Germany | 400/613.2 |
| 140180 | 8/1982 | Japan | 400/613.2 |
| 158274 | 9/1984 | Japan | 400/647.1 |
| 1326722 | 8/1973 | United Kingdom | 400/613.4 |

OTHER PUBLICATIONS

Ryan et al., "Form Stacking Aid", IBM Technical Disclosure Bulletin, vol. 20, No. 1, p. 97, Jun. 1977.

David, "Fan Fold Paper Pack", IBM Technical Disclosure Bulletin, vol. 4, No. 1, p. 1, Jun. 1961.

*Primary Examiner*—William Pieprz

*Attorney, Agent, or Firm*—Townsend and Townsend

[57] ABSTRACT

A printer having a fan folded output is provided with an output catching tray which cantilevers upwardly at an angle of 35°–55° from the printer output. The tray includes side walls defining a bottom which bears on the top of the printer. The sidewalls each define integrally formed hooks for catching onto the printer at any bar of fastening disposed in the area of the output. These books enable the cantilevered support to occur. At the bottom of the tray, an arcuate and cam-like surface is disposed against the printer output. This cam-like surface takes horizontal output from the printer and causes it to pass upwardly over its surface. The cam surface extends from an angle in the range of 45° in vicinity of the printer to a slope beyond horizontal at the bottom of the paper catching tray. The end of the cam and the bottom of the paper catching tray form a notch. The paper catching tray extends upward from the notch at an angle between 30 to 60 degrees, the full length of the fan fold paper, and is preferably provided at the upper end thereof with a paper stop. In operation, fan folded paper output from the printer is fed to the tray, typically to the notch at the end of the cam surface and the beginning of the upwardly extending tray. Thereafter, when printer output occurs, the columnar strength of the paper combined with the natural weight of the paper as it lies on the tray surface causes a fan fold layering of the paper catching tray.

6 Claims, 6 Drawing Figures

FAN FOLDED PRINTER OUTPUT COLLECTOR

This invention relates to a tray attachable to a printer which catches fan folded output.

SUMMARY OF THE RELEVANT LITERATURE

Elaborate schemes are known for capturing fan folded output from printers. See Marker U.S. Pat. No. 4,515,490, Schuller U.S. Pat. No. 4,094,498, MacIntosh Sr. U.S. Pat. No. 4,226,410 and Imagi et al. U.S. Pat. No. 4,095,779.

Printer outputs having reversing cams for allowing paper to pass along the surface of such cams and reverse the stack of paper on top of an existing printer are also known. See, for example, Roy European Patent Application No. 0,150,902 and McCoy U.S. Pat. No. 4,541,749. In the case of both these devices, printer output is fed out of the printer to a cam which reverses the direction of the paper. Unfortunately, such devices obscure viewing of the printout from the computer as it is being made. Convenient access to the printer is also prevented.

It is important to see printout immediately from a computer. Where improper printing occurs, it is important to abort a printing routine as soon as possible to both conserve time and paper.

SUMMARY OF THE INVENTION

A printer having a fan folded output is provided with an output catching tray which cantilevers upwardly at an angle of 20°–50° (30° being preferred) from the printer output. The tray includes side walls defining a bottom which bears on the top of the printer. The sidewalls each define integrally formed hooks for catching onto the printer at any bar or fastening disposed in the area of the output. These hooks enable the cantilevered support to occur. At the bottom of the tray, an arcuate and cam-like surface is disposed against the printer output. This cam-like surface takes horizontal output from the printer and causes it to pass upwardly over its surface. The cam surface extends from an angle in the range of 45° in vicinity of the printer to a slope beyond horizontal at the bottom of the paper catching tray. The end of the cam and the bottom of the paper catching tray form a notch. The paper catching tray extends upward from the notch at an angle between 30 to 60 degrees, the full length of the fan fold paper, and is preferably provided at the upper end thereof with a paper stop. In operation, fan folded paper output from the printer is fed to the tray, typically to the notch at the end of the cam surface and the beginning of the upwardly extending tray. Thereafter, when printer output occurs, the columnar strength of the paper combined with the natural weight of the paper as it lies on the tray surface causes a fan fold layering of the paper catching tray.

Other Objects And Advantages

An object of this invention is to disclose a tray which gathers computer printouts so that it may be conventionally observed and read during printing. According to this aspect of the invention, a cantilevered tray is mounted to the printer in the vicinity of the output, typically by having hooks on the side walls engage a bar with the tray cantilevered upwardly and outwardly from the printer. A cam feeds the printout from the printer to a notch formed by the end of the cam surface and the beginning of the tray. Printer output fan folds into the tray.

An advantage of the tray is that the printer output may at all times be observed and read.

A further advantage of this is the tray does not have an elaborate pathway for the produced printout. Rather a simple fan folding on the output just as a fan folding on the input occurs.

Another advantage of the disclosed tray is that the paper input to the printer is not interfered with. Typically, there is a defined pathway underneath the tray which allows the input to be uninterrupted.

Yet another advantage of the disclosed invention is that the disclosed tray does not appreciably add to the space occupied by the printer. Instead, the tray counterlevers upwardly and outwardly from the back of the printer. The horizontal area occupied by a printer equipped with the tray is not appreciable increased.

A final advantage is that the disclosed tray is completely passive. It is without moving parts so that the printer output is collected with a minimum of operation.

Other objects, features, and advantages of this invention will be more apparent after referring to the following specification and attached drawings.

DESCRIPTION OF THE PREFERRED EMBODIMENTS

Figure 1:
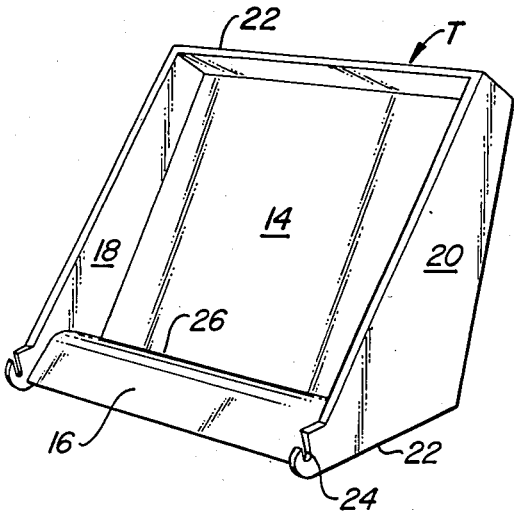
FIG. 1 is a perspective view of the tray separate and apart from the printer illustrating the hooks attached to the side wall and the cam surface in detail.

Referring to FIG. 1, tray T is shown having a back surface 14, a cam surface 16, and paired side walls 18 and 20. A top wall portion 22 is provided to limit the upward movement of the length of the fan folded output.

Each of the walls 18, 20 are trapezoidal in shape with a lower edge 22 for resting on the top of the printer and an integral hook 24 for attaching to a bar in the vicinity of the printer output. As is apparent, hook 24 will have to be configured for the type of printer utilized. It will admit of a number of configurations. Typically, hook 24 is configured to dispose its opening upwardly. This upward disposition is so that when surface 22 rests on the top of the printer, the hook is biased upwardly and into a bar in the vicinity of the printer output. Other attachments may be used as well.

Tray T has its surface 14 disposed so that paper will remain in the tray under the force of gravity. Consequently, tray surface 14 is disposed at an angle between 30° and 60° from the horizontal.

A cam surface 16 is provided adjacent the printer output. It is presumed that the printer output has a substantial horizontal vector so that printer output passes outwardly and upwardly over the surface of the cam to notch 26.

Notch 26 is formed by the juncture defined by the end of the cam surface 16 and the bottom of the tray 14. It will be seen that cam surface 16 begins with an upwardly sloping surface in the order of approximately 30°. This surface tapers to the horizontal and thereafter beyond the horizontal to where the end of the cam 16 meets the tray 14. Notch 26 is formed at this juncture, which notch 26 will be more fully understood with respect to the views of FIGS. 3A and 3B.

At that top, the printer is provided with a top wall 22. Typically top wall 22 is a end of form stop. This end of form stop is desirable but not required; the stop limits any upward movement of the fan folded output.

Further, it may be desirable to add structural reinforcing as by putting gussets in the bottom of the cam 16 (such gussets not shown in the view of FIG. 1). As these gussets are for structural purposes and do not form an operative portion of the invention, they are omitted from the view of FIG. 1.

Figure 2:
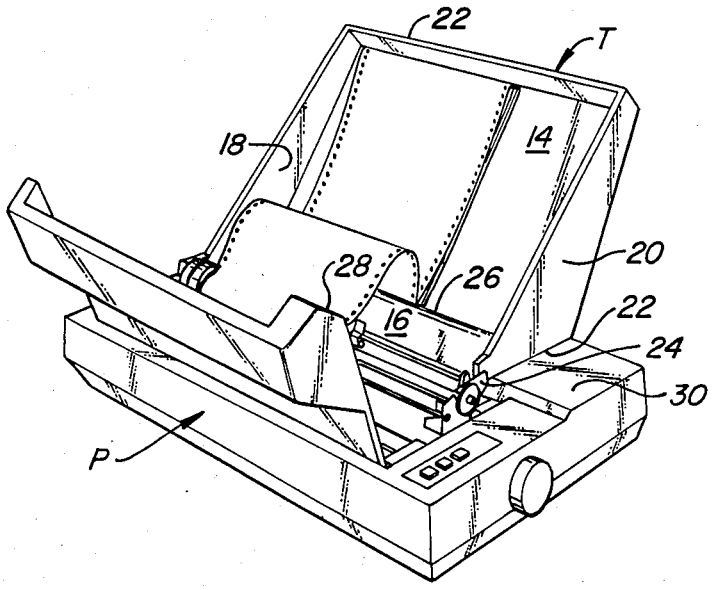
FIG. 2 is a view similar to FIG. 1 with the tray shown attached to and cantilevering out from a bar adjacent to the printer output.

Referring to FIG. 2, tray T is shown fastened to a printer. The particular printer here shown is an Epson dot matrix printer having a tractor feed manufactured by the Epson Company of Tokyo, Japan. Typically, the hooks 24 are shown engaged to a bar 26 in the vicinity of the printer output 28. As can be seen the lower edge 22 rests on the top of the printer 30.

The printer has a substantially horizontal output. The output does not have a discharge angle exceeding 45° from the horizontal.

What is not immediately apparent, is that the input path of paper to the printer T is substantially not interfered with. Typically, the paper winds around the back of the printer P and enters the printer before and under the cam 16.

Having described the completely passive printer collector, its operation may now be set forth. This can best be seen with respect to the cartoon FIGS. 3A, 3B, and 3C.

Figure 3A:
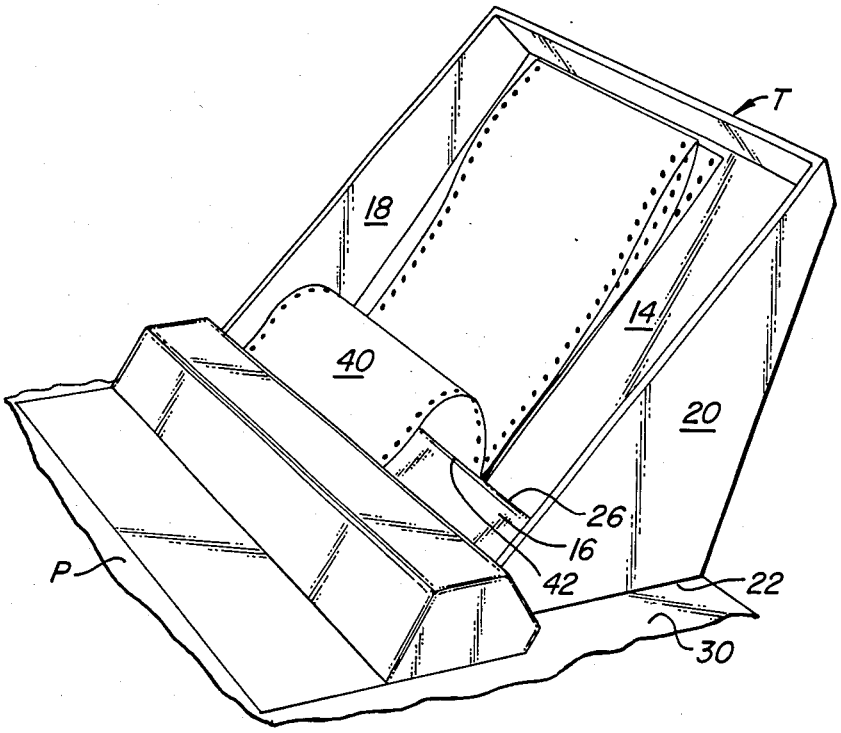
FIGS. 3A–3C are a cartoon series illustrating the fan folded collection of printer output.

Referring to FIG. 3A, the original output of paper 40 is typically threaded with its leading edge 42 so as to reside in the notch 26 at the bottom of cam 16 and tray surface 14. The paper 40 then is feed from the printer as it is printed.

The reader will observe that the printed side of the paper 40 is exposed. Therefore, the tray device does not interfere with the viewing of the paper printout as it occurs from the printer.

Figure 3B:
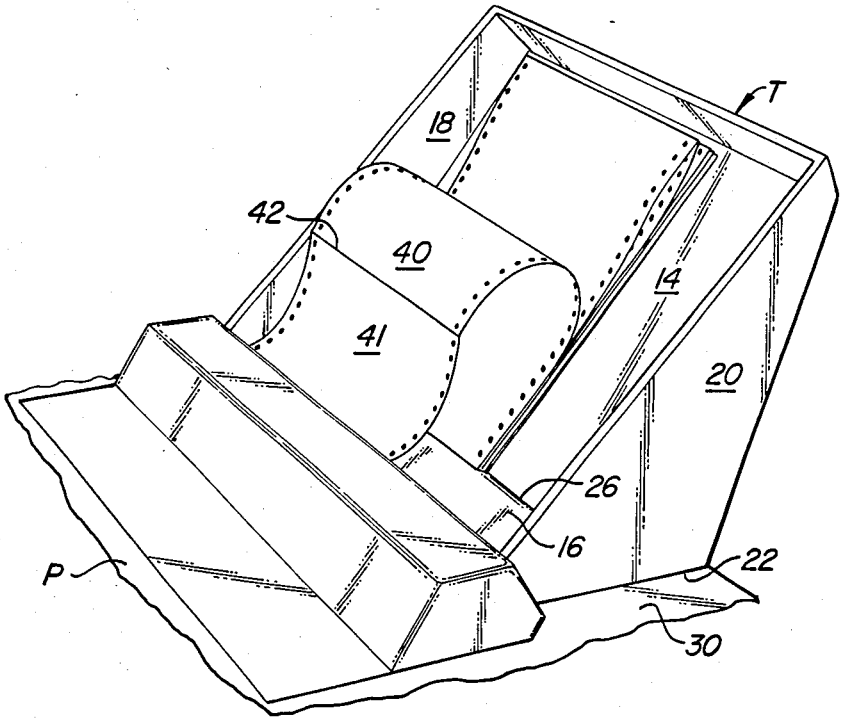

Referring to FIG. 3B, the first sheet 40 is shown completely dispensed from the printer P. At the same time, a second sheet 41 connected by the fan fold 42 is being dispensed from the printer.

Stopping at this juncture two forces can be seen cooperating which enable the static collection of paper from this printer tray.

First, the weight of the paper sheet 40 is tending to cause the paper as dispensed from the tray to lay down on the tray.

Secondly, the columnar strength of the sheet 41 is pushing the fan fold 42 upwardly. This columnar strength is accompanied also by the weight of sheet 41 trying to lie down on surface 14 of the tray.

Figure 3C:
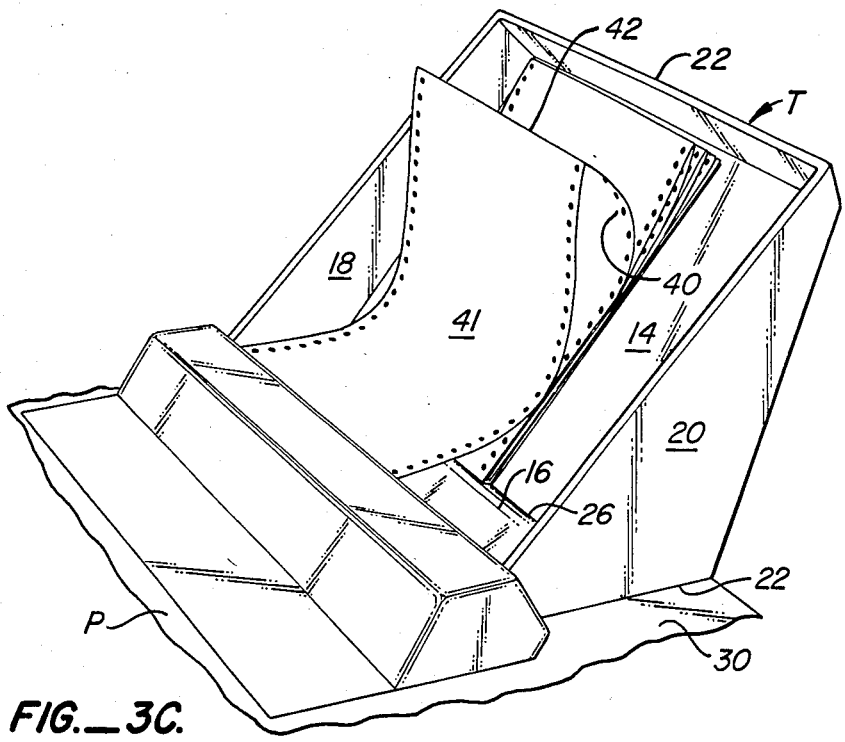

Referring to FIG. 3C, the process is shown almost completed. Sheet 40 is almost ready to lie down on the tray surface 14. At the same time, sheet 41 is almost fully fed out of the printer. Fan fold 42 is ready to abut upper wall 22 of the printer.

When fan fold 42 abuts upper wall 22 the process will be completed. At that time, the next fan fold will be located at notch 26 at the bottom of sheets 40, 41. Thereafter the process illustrated in FIGS. 3A, 3B, and 3C will be repeated.

The reader will discover that the disclosed paper catching tray is remarkably simple. It has no moving parts and is wholly static. Further, it is not subject to width restrictions of any kind. Consequently, it can be placed on printers having a spatial interval for 8" paper to printers having a spatial interval for 14" paper. Further, the amount of material collectible is substantial so long as the cam surface 16 and its paper feeding function are not substantially interfered with.

Printers are known which discharge their fan fold printout substantially upwardly. In such types of printers, the cam surface 16 requires the printout be deflected to a substantially horizontal output. It is preferred that such printout does not exceed 45° from the horizontal.

Figure 4:
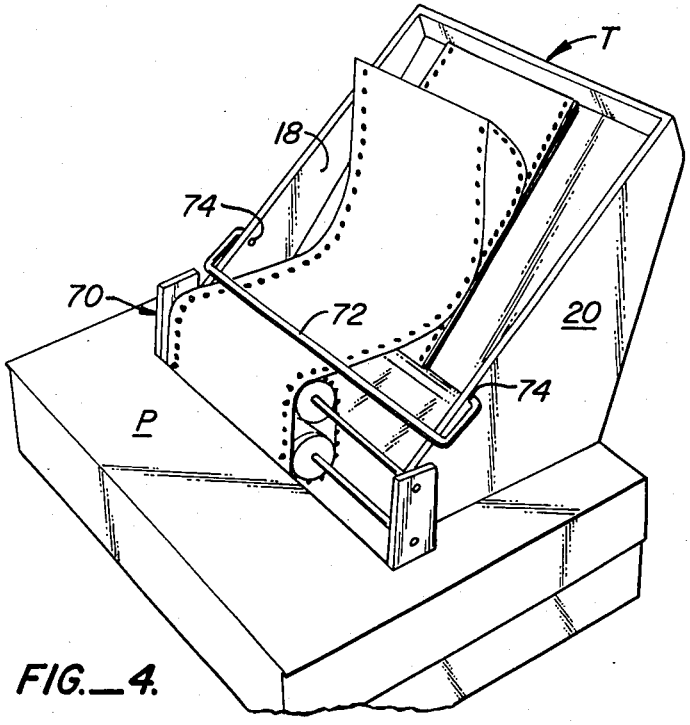
FIG. 4 is a perspective view of an adaptation of the invention herein to a printer having a substantially vertical paper output.

Referring to FIG. 4, a printer P having a tractor feed 70 with a substantially upward discharge is illustrated. The discharge occurs to a tray T.

A horizontal guide bar 72 of circular section is illustrated hinged about points 74 in respective tray sidewalls 18–20. All other details of the discharge of paper from the printer as well as the construction of the tray T are identical, with suitable modification being made to the points of printer attachment (the hook 24 illustrated in FIG. 1).

What is claimed is:

1. A paper collecting tray for attachment to a printer, said printer having fan folded printer output which is guided from the printer exit towards said tray in a substantially horizontal direction, said tray comprising:

a tray body;

a cam surface attached to said tray body, said cam surface adjacent said printer exit for receiving said printer output and guiding said printer output to and towards a paper receiving notch, said cam surface sloping from the point of printer output from said printer exit to an angle below the horizontal and substantially normal to said tray body whereby fan folded printer output impinges upon said cam surface, climbs over the top of said cam surface, and passes to said paper receiving notch;

means for cantilevering said tray body from said printer adjacent said paper exit attached to said cam surface and tray surface; and a tray surface on said tray body extending upwardly at an angle cantilevered from said printer exit in the range of 20° to 50°, said tray surface terminating at the lower end of said tray at said cam surface to define said paper receiving notch therebetween, whereby the major surface of said fan folded paper having a fold on said paper receiving notch stacks on said tray surface utilizing the columnar strength of said paper and the weight of said paper.

2. The invention of claim 1 and wherein said cam surface defines thereunder a paper input path for said printer.

3. The invention of claim 1 wherein said means for cantilevering said tray surface to said printer includes first and second side walls, each side wall adjoined to an end of said cam surface and an end of said tray surface to hold said cam and tray as a unitary member;

said side walls defining hooks for receiving a bar in the vicinity of said printer exit.

4. In combination, a printer, said printer having a fan folded printer output which is guided from a printer exit in a substantially horizontal direction;

a fan fold collecting tray comprising in combination a cam surface for receiving said printer output at the printer exit and a tray surface disposed for extending from the vicinity of the printer exit upwardly and angularly away from the printer, said cam surface and said tray surface forming a bottom disposed notch therebetween for receiving printer output at a fold; and said cam surface sloping adjacent the point of horizontal output from said printer exit to an angle below the horizontal and substantially normal to said tray, whereby fan folded paper impinges upon said cam surface and passes to said paper receiving notch;

means for attaching said tray to said printer in the vicinity of said printer exit whereby the print receiving tray is cantilevered upwardly and away from said printer output at an angle between 20° and 50° whereby the major surface of said fan folded paper having a fold on said paper receiving notch stacks on said tray surface utilizing the columnar strength of said paper and the weight of said paper.

5. The invention of claim 4 and wherein said means for attaching said tray to said printer includes first and second side walls, said side walls joining said cam and tray receiving surface together; and said side walls defining a hook for engaging said printer in the vicinity of said printer exit.

6. The combination of claim 5 and wherein said tray includes means for causing said printer to output said paper in a substantially horizontal direction.

* * * * *